United States Patent [19]

Sova

[11] Patent Number: 5,003,906

[45] Date of Patent: Apr. 2, 1991

[54] APPARATUS AND METHOD FOR AUTOMATIC OPERATION OF A BILGE BLOWER

[75] Inventor: Phillip R. Sova, Indian River, Mich.

[73] Assignee: Technological Safety Design, Inc., Indian River, Mich.

[21] Appl. No.: 450,218

[22] Filed: Dec. 13, 1989

[51] Int. Cl.[5] ..... B63J 2/06

[52] U.S. Cl. ..... 114/211

[58] Field of Search ..... 114/173, 177, 183 R, 114/211, 212; 440/1, 2, 87; 340/517; 307/9.1

[56] References Cited

U.S. PATENT DOCUMENTS

| | | | |
|---|---|---|---|
| 2,627,181 | 2/1953 | Kiekhaefer | 440/2 |
| 3,489,912 | 1/1970 | Hoffman | 114/211 |
| 3,652,868 | 3/1972 | Hunt | 114/211 |
| 3,948,202 | 4/1976 | Yoshikawa | 114/211 |
| 4,134,112 | 1/1979 | Kercheval et al. | 114/211 |
| 4,235,181 | 11/1980 | Stickney | 114/211 |

*Primary Examiner*—Sherman D. Basinger

*Assistant Examiner*—Stephen P. Avila

*Attorney, Agent, or Firm*—Brooks & Kushman

[57] ABSTRACT

In combination with a water craft (10) having an engine compartment (12), a blower (14) for purging the compartment of noxious vapors, an electrical system (16) for energizing the water craft, a manual blower switch (18), and a speedometer (20) including a tube (22) which provides fluid pressure thereto for sensing the speed of the water craft (10) through ambient water, an improvement comprising a normally closed pressure switch (24) connected to the tube (22). The pressure switch (24) is openable in response to fluid pressure in the tube (22) at speeds above a pre-determined speed of the water craft (10). Electrical connections (26, 28) are provided between the pressure switch (24), the electrical system (16) and the blower (14). The pressure switch (24) bypasses the manual blower switch (18) so that the blower (14) is operated pressure-responsively, irrespective of the manual blower switch (18) when the speed of the water craft (10) is below the predetermined speed, thereby enhancing boating safety.

13 Claims, 2 Drawing Sheets

APPARATUS AND METHOD FOR AUTOMATIC OPERATION OF A BILGE BLOWER

TECHNICAL FIELD

This invention relates to water craft, more specifically to an apparatus and method for automatic operation of a bilge blower for purging an engine compartment of noxious vapors.

BACKGROUND ART

In the never-ending quest for optimal use of scarce leisure time, an increasing number of people are turning to water craft for cruising, fishing, exploring, towing water skiers, and other purposes. One common thread between maritime regulations which apply to commercial and leisure activities is the paramount importance given to considerations which compensate for inattention. Such regulations and recommended operating practices have a common purpose: to make boating safer.

Over the years, those going down to the sea in ships include not only the old salt but also those whose experience in maritime practices is lacking. Regardless of experience level, alcohol consumption, if present, may affect the judgment of all boat operators. Ideally, water craft systems should be designed with human factors in mind so that safe operating practices are less dependent on such human factors. One way to achieve this goal is to provide systems which are operable in spite of human error.

One consideration which confronts the operators and passengers of motor-driven vessels is the accumulation of noxious gasses in an engine compartment when the vessel is at rest or is travelling slowly below wake speed, which the vessel is often required to do when navigating through inland waters. At higher speeds, air intake scoops mounted on the outside of the hull ingest ram air into and through the engine compartment, thereby purging the compartment of noxious vapors. When the boat is at rest or idling slowly for long periods, operating practices require the operator to activate a manual blower switch in order to expel unwanted gasses from the engine compartment.

Following engine start-up checklists, the boat operator may have little difficulty in remembering to activate a manual blower motor switch for a period of time before starting the engine Failure to follow such checklists, however, may result in the operator failing to turn on the manual blower motor before engine start. Difficulties linger, for example, when the distraction of picking up a fallen skier diverts the operator's attention from the need to expel noxious gasses from the engine compartment. During the time interval when he doubles back, slows down, and drifts in the water while the skier remounts his skis, the operator's attention is focused outside the boat on the skier. The operator's attention is not directed inside the boat, nor on a potential need to activate the manual blower motor switch. If this period of time is excessive, there may be an accumulation of noxious gasses which are not purged by the movement of air through the engine compartment, or by a deactivated blower motor.

For these reasons, it would be desirable to have a device which automatically operates a bilge blower motor in response to the speed of the water craft, so that the blower motor is operated whenever the water craft is at rest or its speed is below a pre-determined value, regardless of the setting of the manual blower switch. If the operator failed to activate the blower switch manually, the device would automatically activate the blower.

Additionally, such a device would have the attribute of reducing the number of things which the boat operator needs to remember to do, and would have the beneficial affect of decreasing his work load in operating the boat safely.

Furthermore, it would be extremely useful to be able to purchase such a device relatively inexpensively, install it readily, and to be able to utilize a device which would readily be compatible with most systems found in vessels currently in use.

DISCLOSURE OF INVENTION

Most of the water craft afloat today include an engine compartment, a blower for purging the compartment of noxious vapors, and an electrical system for energizing the water craft. Typically, the blower includes a manual blower switch for operating the blower. To enable the operator to monitor the speed of the water craft in the water, a pressure-sensitive speedometer including an inlet tube is typically provided. The pressure-sensitive speedometer is responsive to fluid pressure exerted along the inlet tube by movement of the water craft through ambient water. In combination with such conventional features, an improvement is provided which comprises a normally closed pressure switch connected to the inlet tube. The normally closed pressure switch is openable in response to fluid pressure in the inlet tube at speeds above a predetermined speed of the water craft. Connections are provided between the pressure switch, the electrical system, and the blower. The connections bypass the manual blower switch so that the blower is operated pressure-responsively by the pressure switch, irrespective of the manual blower switch setting when the speed of the water craft is below the predetermined speed.

The present invention also contemplates a method of controlling the operation of a blower used to purge noxious vapors from the engine compartment of the water craft. The method comprises the steps of determining the speed of the water craft through the water by sensing fluid pressure in the inlet tube which extends from the water craft into the water, and operating the blower in response to one of such fluid pressures when the speed of the water craft is below the pre-determined value.

The objects, features, and advantages of the present invention are readily apparent from the following detailed description of the best mode for carrying out the invention when taken in connection with the accompanying drawings.

BEST MODES FOR CARRYING OUT THE INVENTION

Figure 1:
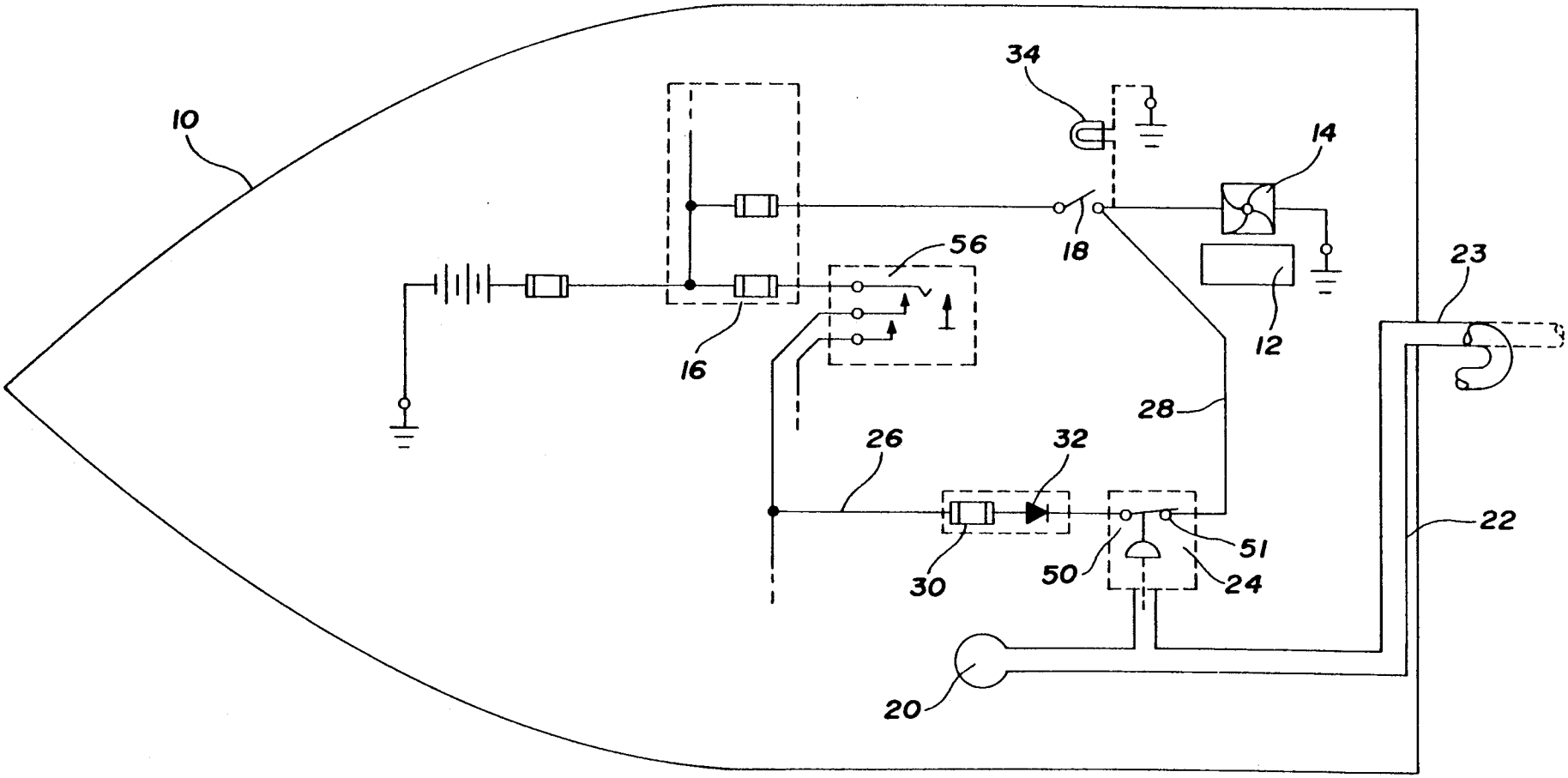
FIG. 1 is a schematic diagram of a water craft having on-board systems which include the improvement of the present invention.

Turning first to FIG. 1, there is shown a water craft 10 having an engine compartment 12 with a blower 14 for purging the compartment 12 of noxious vapors. As is usually found in such water craft 10, a pressure-sensitive speedometer 20 typically includes an inlet tube 22 having an intake end 23 which is mounted below the vessel's water line. Good results have been obtained when the intake end 23 is mounted aft of the vessel, approximately 2–4 inches below the water line adjacent the transom. The intake end 23 of the inlet tube 22 receives water which is delivered thereto by hydrostatic pressure when the vessel has no speed in relation to the ambient water and by hydrodynamic pressure exerted by movement of the water craft through the ambient water. As is well known, such hydrodynamic pressure rises dependent upon the speed of the water craft 10 through the water. Pressure-sensing devices (not shown) within the speedometer are connected to an analog or digital indicator in the speedometer 20 which provides to the vessel's operator an indication of boat speed.

Connected to the inlet tube 22 is a normally closed pressure switch 24 which is openable in response to fluid pressure in the inlet tube 22 at speeds is above a pre-determined speed of the water craft 10, such as about 10 knots.

Continuing with reference to FIG. 1, a first electrical path 26 links the electrical system 16 and the pressure switch 24. To connect the pressure switch 24 and the blower 14, a second electrical path 28 is provided. With this configuration, the pressure switch 24 effectively bypasses the manual blower switch 18. As a result, the blower 14 can be operated pressure-responsively by the pressure switch 24, irrespective of the manual blower switch 18 when the speed of the water craft 10 is below the pre-determined speed. Consequently, the engine compartment 12 is purged of noxious gases by the blower 14 automatically whenever the boat speed is below the pre-determined value, regardless of whether the vessel's operator remembers to activate the manual blower switch 18.

As depicted in FIG. 1, the second electrical path 28 is connected to a terminal of the manual blower switch 18. It will readily be apparent to those of ordinary skill in the art that the second electrical path 28 could also be connected to a terminal of the blower 14 without impairing operation of the present invention.

With continuing reference to FIG. 1, it can be seen that the first electrical path 26 comprises a fuse 30 for deactivating the pressure switch if there are unwanted power surges. Good results have been obtained when a fuse 30 is selected so as to have approximately a 6 ampere rating. As can be seen in FIG. 1, the first electrical path 26 may also include a diode 32. In practice, a preferred embodiment of the first electrical path 26 includes the fuse 30 and the diode 32.

To provide an indication that the blower 14 is in operation, an indicator 34 is provided in the second electrical path 28. As can readily be appreciated by one of ordinary skill in the art, the indicator 34 could perform quite satisfactorily if connected to the first electrical path 26.

Figure 2:
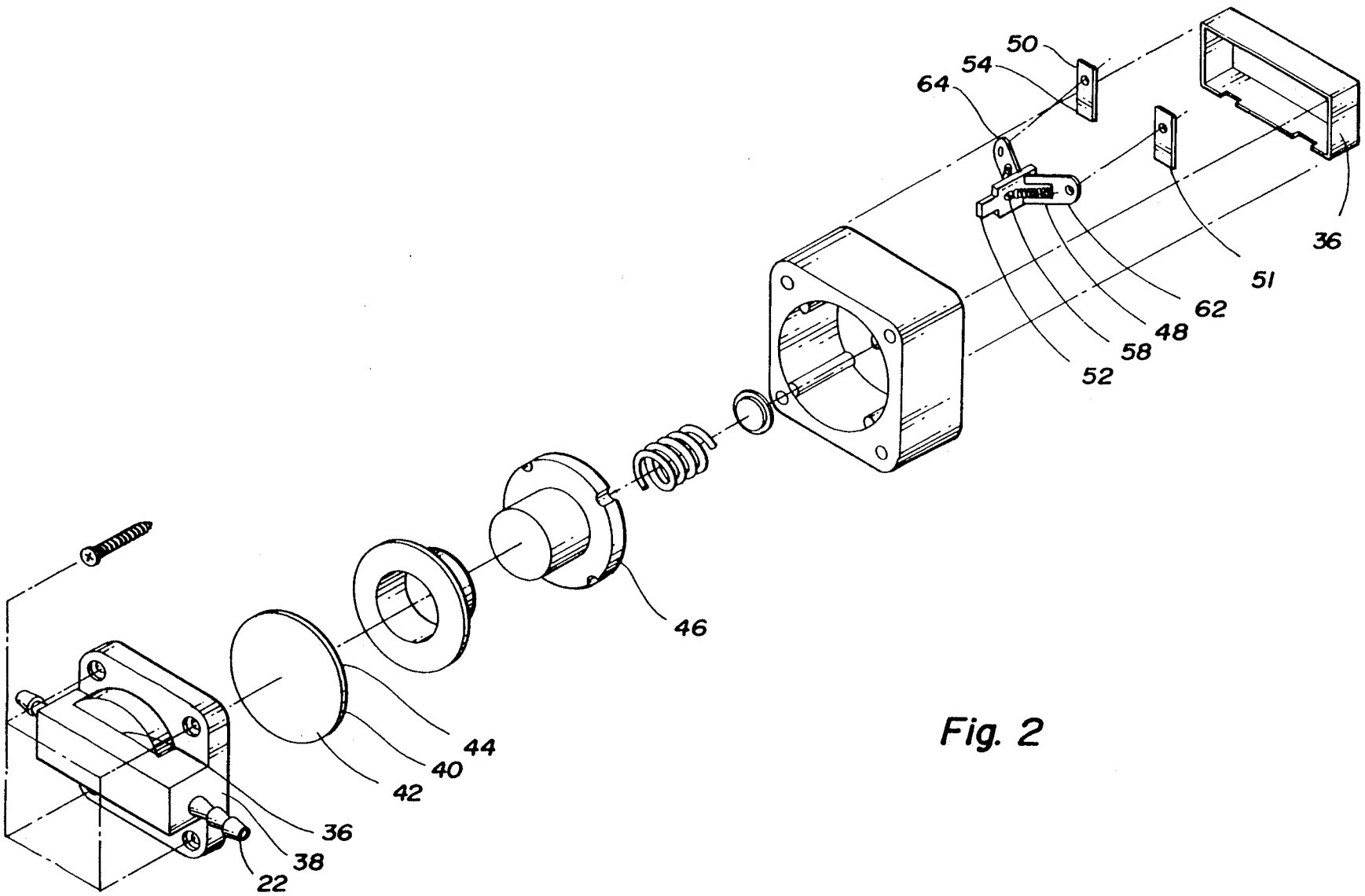
FIG. 2 is an exploded perspective view of a normally closed pressure switch as incorporated in the device of the present invention.

Turning now to FIG. 2, there is provided an illustration of one embodiment of the pressure switch 24 which has been adapted for use in the present invention. In this embodiment, the pressure switch 24 includes a housing 36 having a port 38 connected to the inlet tube 2 which is in communication with the speedometer 20. Adjacent the port 38 is a diaphragm 40 having a first face 42. The diaphragm 40 is movable within the housing 36 in response to pressure in the inlet tube 22 which is communicated through the port 38. On the opposite side of the diaphragm 40 from the first face 42 is a second face 44. A plunger assembly 46, like the diaphragm 40, is adapted to move within the housing 36 in response to inlet pressure delivered to the first face 42 of the diaphragm 40. To urge the plunger assembly 46 against the second face 44 of the diaphragm 40, a spring is provided which extends between the plunger assembly 46 and the housing 36.

Also extending between the plunger assembly 46 and the housing 36 is a connector assembly 48. As shown in FIG. 2, the connector assembly 48 includes a central post 58 and a pair of pivotable arms 62, 64 extending therefrom. The pivotable arms 62, 64 straddle a pair of terminals 50, 51. As can readily be appreciated by reference to FIGS. 1 and 2 taken together, the pair of terminals 50, 51 respectively link the pressure switch 24 to the first and second electrical paths 26, 28.

The connector assembly 48 is movable between a retracted normally closed position 52 and an extended open position 54 which is shown in FIG. 2 in phantom. Each pivotable arm 62, 64 includes a conducting portion at each distal end and an insulated portion located proximate the post 58. In the normally closed retracted position 52, the conductor portions of each pivotable arm 62, 64 are in contact with the pair of terminals 50, 51, thereby closing the first and second electrical paths, 26, 28. When the fluid pressure in the inlet tube 22 moves the diaphragm 40 and plunger assembly 46 outwardly relative to the port 38, the post 58 of the connector assembly 48 also moves outwardly. This movement causes the pivotable arms 62, 64 to move outwardly, moving arcuately away from the post 58 so that their insulated portions abut the pair of terminals 50, 51. The first and second electrical paths 26, 28 are thereby interrupted. When this occurs, the blower 14 can only be activated by closing the manual switch 18.

When the connector assembly 48 is in the retracted, normally closed position 52, however, the blower 14 is energized, regardless of the setting of the manual switch 18.

There are available several pressure switches which can be modified for use with the present invention. One such switch is that manufactured by the Flow Jet Corporation, located in California. It will readily be appreciated that other embodiments of normally closed pressure switches 24 are possible, and that only one such embodiment has beer disclosed for illustrative purposes.

Alternative approaches to utilization of the pressure switch will be apparent to those of skill in the art. For example, FIG. 1 shows the intake end 23 curved so as to disclose ram intake. In phantom form, extending directly aft is an alternative configuration of the intake end 23. Under the latter configuration, negative pressure is received by the intake end 23. The pressure switch 24 may then be configured to operate by sensing negative pressure merely by reversal of the appropriate connections.

It will also be appreciated that the intake end 23 need not necessarily be emersed in ambient water. As disclosed, the invention is readily operable by exposing a ram intake inlet end 23 to ambient air in much the same way as, for example, a pivot tube which is conventionally used on aircraft to indicate speed.

To avoid unnecessary wear on the blower 14, the pressure switch 24 deactivates the blower 14 if the manual blower switch 18 is open as the speed of the water craft 10 rises to or above the predetermined speed.

Turning back to FIG. 1, it will be apparent that whenever the speed of the water craft 10 is below the pre-determined speed, the blower 14 is energized by the pressure switch 24 even if the manual blower switch is turned off.

In practice, a pressure increment of about 3 pounds per square inch above atmospheric pressure is sufficient to cause the normally closed pressure switch 24 to become opened.

The improvement disclosed by the present invention offers safety features which were theretofore not available. It can readily be appreciated that, for example, when the water craft 10 is docked, the blower 14 will become energized if the ignition switch is on regardless of the setting of the manual blower switch 18 because the water craft 10 is at rest, i.e. below the pre-determined speed. As the water craft 10 leaves the dock, it may travel through a no-wake zone for a significant period of time. During that period, the relatively slow progress of the water craft 10 through the air is insufficient to allow air scoops on the hull to ingest enough air to expel noxious vapors from the engine compartment 12. During this entire period, the operator's workload is alleviated and he can concentrate on all aspects of boat management other than the need to activate the manual switch 18. This is because such manual activation is obviated by the present invention.

Imagine that later he tows a water skier behind his water craft 10 and the water skier falls. The operator will, in picking up the water skier, slow down his boat, reverse course, and slowly idle in the water where the skier is floating. It is understandable that the boat's operator has his attention primarily focused outside the boat on the water skier. His focus may now be well placed because the improvement of the present invention obviates the need to manually activate the blower 14. This is because the vessel's speed has decreased from towing speed, through the pre-determined speed, to an idle speed. On passing below the pre-determined speed, the blower 14 automatically becomes activated, regardless of the setting of the manual switch 18.

In summary, there has been disclosed a method of controlling the operation of the blower 14 which is used to purge noxious vapors from the engine compartment 12 of the water craft 10. The method comprises the steps of determining the speed of the water craft 10 through the water by sensing fluid pressures in the inlet tube 22 which extends from the water craft 10 into the water. Next, the blower 14 is operated in response to one of such fluid pressures which is sensed when the speed of the water craft 10 is below the pre-determined value.

While the best mode for carrying out the invention has been described in detail, those familiar with the art to which this invention relates will recognize alternative ways of practicing the invention as defined by the following claims.

What is claimed is:

1. In combination with a water craft having an engine compartment, a blower for purging the compartment of noxious vapors, the blower including a manual blower switch for operating the blower, an electrical system for energizing the water craft and the blower switch, and a pressure-sensitive speedometer including an inlet tube, the pressure-sensitive speedometer being responsive to fluid pressure exerted along the inlet tube by movement of the water craft through ambient water, an improvement comprising:

a normally closed pressure switch connected to the inlet tube, said pressure switch being continuously openable in response to fluid pressure in the inlet tube at speeds above a predetermined speed of the water craft, a first electrical path between the electrical system and said pressure switch, and a second electrical path between said pressure switch and the blower and in parallel with the blower switch, wherein said pressure switch bypasses the manual blower switch so that the blower is operated pressure responsively by said pressure switch, irrespective of the manual blower switch when the speed of the water craft is below said predetermined speed.

2. The improvement of claim 1, wherein said first electrical path comprises a fuse.

3. The improvement of claim 1, wherein said first electrical path comprises a diode.

4. The improvement of claim 1, wherein said first electrical path comprises a diode and a fuse.

5. The improvement of claim 1, wherein said second electrical path comprises an indicator which signals whenever the blower is in operation.

6. The improvement of claim 4, wherein said second electrical path comprises an indicator which signals whenever the blower is in operation.

7. The improvement of claim 1, wherein said pressure switch comprises:

a housing having a port connected to the inlet tube;

a diaphragm which is moveable within said housing in response to pressure in the inlet tube, said diaphragm having a first face extending over said port and a second face on the opposite side of said diaphragm from said first face;

a plunger assembly in abutting relationship with said second face of said diaphragm, said plunger being adapted to move within said housing in response to movement of said diaphragm;

a spring mounted between said housing and said plunger for urging said plunger against said second face of said diaphragm;

a connector assembly extending between said plunger assembly and said housing; and a pair of terminals mounted on said housing for electrical linkage to said first and second electrical paths, said connector assembly being operable between a retracted, normally closed position in cooperation with said pair of terminals when the pressure in the inlet tube corresponds to speeds below said pre-determined speed, and an extended, open position when the pressure in the inlet tube corresponds to speeds at or above said pre-determined speed.

8. The improvement of claim 1, wherein the blower is de-activated by said pressure switch as the speed of the water craft rises to or above said predetermined speed.

9. The improvement of claim 1, wherein said first electrical path comprises an indicator for signalling when the blower is in operation.

10. In combination with a water craft having an engine compartment, a blower for purging the compartment of noxious vapors, the blower including a manual blower switch for operating the blower, an electrical system for energizing the water craft and the blower switch, and a pressure-sensitive speedometer including an inlet tube, the pressure-sensitive speedometer being responsive to fluid pressure exerted along the inlet tube by movement of the water craft through ambient water, an improvement comprising:

a normally closed pressure switch connected to the inlet tube, said pressure switch being openable in response to fluid pressure in the inlet tube at speeds above a predetermined speed of the water craft, a first electrical path between the electrical system and said pressure switch, and a second electrical path between said pressure switch and the blower and in parallel with the blower switch, wherein said pressure switch bypasses the manual blower switch so that the blower is operated pressure responsively by said pressure switch, irrespective of the manual blower switch when the speed of the water craft is below said predetermined speed, said pressure switch having:

a housing having a port connected to the inlet tube;

a diaphragm which is moveable within said housing in response to pressure in the inlet tube, said diaphragm having a first face extending over said port and a second face on the opposite side of said diaphragm from said first face;

a plunger assembly in abutting relationship with said second face of said diaphragm, said plunger being adapted to move within said housing in response to movement of said diaphragm;

a spring mounted between said housing and said plunger for urging said plunger against said second face of said diaphragm;

a connector assembly extending between said plunger assembly and said housing; and a pair of terminals mounted on said housing for electrical linkage to said first and second electrical paths, said connector assembly being operable between a retracted, normally closed position in cooperation with said pair of terminals when the pressure in the inlet tube corresponds to speeds below said pre-determined speed, and an extended, open position when the pressure in the inlet tube corresponds to speeds at or above said pre-determined speed.

11. A method of continuously controlling the operation of a blower used to purge noxious vapors from an engine compartment of a water craft, comprising the steps of:

determining the speed of the water craft through the water by sensing fluid pressures in an inlet tube extending from the water craft, and operating the blower in response to one of such fluid pressures sensed when the speed of the water craft is below a predetermined value independent of engine RPM.

12. The method of claim 11 wherein fluid pressures are sensed in an inlet tube extending into the water.

13. The method of claim 11 wherein the fluid pressures are sensed in an inlet tube extending into ambient air.

* * * * *